US009833996B2

(12) United States Patent
Wang et al.

(10) Patent No.: US 9,833,996 B2
(45) Date of Patent: Dec. 5, 2017

(54) ORIFICE SURFACE, PRINT HEAD COMPRISING AN ORIFICE SURFACE AND METHOD FOR FORMING THE ORIFICE SURFACE

(71) Applicant: Océ-Technologies B.V., Venlo (NL)

(72) Inventors: Zhanhua Wang, Venlo (NL); Johannes T. Zuilhof, Venlo (NL); Marcus J. Van den Berg, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/363,747

(22) Filed: Nov. 29, 2016

(65) Prior Publication Data

US 2017/0151787 A1 Jun. 1, 2017

(30) Foreign Application Priority Data

Nov. 30, 2015 (EP) ..... 15197040

(51) Int. Cl.
*B41J 2/135* (2006.01)
*B41J 2/16* (2006.01)

(52) U.S. Cl.
CPC ..... *B41J 2/164* (2013.01); *B41J 2/162* (2013.01); *B41J 2/1626* (2013.01)

(58) Field of Classification Search
None
See application file for complete search history.

(56) References Cited

U.S. PATENT DOCUMENTS

2002/0097296 A1 7/2002 Yamamoto et al.
2012/0270344 A1* 10/2012 Zhao ..... B41J 2/1606 438/21
2012/0288637 A1 11/2012 Godet et al.
2013/0081812 A1* 4/2013 Green ..... C09K 8/805 166/280.1

FOREIGN PATENT DOCUMENTS

WO WO 2008/109910 A1 9/2008
WO WO 2008/109913 A1 9/2008

OTHER PUBLICATIONS

Bhairamadgi et al., "Adhesion and Friction Properties of Fluoropolymer Brushes: On the Tribological Inertness of Fluorine", Langmuir, vol. 30, 2014, pp. 12532-12540.
European Search Report, dated Mar. 27, 2017, for European Application No. 16201067.

* cited by examiner

*Primary Examiner* — Erica Lin
(74) *Attorney, Agent, or Firm* — Birch, Stewart, Kolasch & Birch, LLP

(57) ABSTRACT

Disclosed is a method for preparing a nozzle surface provided with a coating having anti-wetting and anti-fouling property. The method is based, for example, on the self-healing property of the coating used in the method. Also disclosed is a nozzle surface having such coating and a print head having the nozzle surface.

9 Claims, 3 Drawing Sheets

ORIFICE SURFACE, PRINT HEAD COMPRISING AN ORIFICE SURFACE AND METHOD FOR FORMING THE ORIFICE SURFACE

CROSS-REFERENCE TO RELATED APPLICATIONS

This application claims priority under 35 U.S.C. §119(a) to Application No. 15197040.7, filed in Europe on Nov. 30, 2015, the entire content of which is herein explicitly incorporated by reference.

FIELD OF THE INVENTION

The present invention relates to an orifice surface provided with a coating. The invention further relates to a print head comprising such nozzle surface and to a printing apparatus comprising said print head. In addition, the invention relates to a method for forming an orifice surface.

BACKGROUND OF THE INVENTION

In a known print head, the print head comprises a surface having arranged therein at least one nozzle. Ink is ejected from the print head through said nozzle. When printing, ink may be spilled on the nozzle surface of the print head. Ink present on the nozzle surface close to a nozzle may have a negative influence on the performance of a print head during jetting of the ink. Therefore, it is important to prevent the presence of contaminants, such as ink, on the nozzle surface. Hence, an anti-wetting coating may be applied to the nozzle surface to prevent ink from staying on the nozzle surface. However, it is undesired that the anti-wetting coating is present in the inside of the nozzle, because this may result in jetting problems.

Nozzles surfaces may be prepared in a process comprising one or more etching steps, wherein through holes are formed in a plate. These through holes may serve as nozzles when the plate is incorporated in a print head as a nozzle surface. Because it is preferred to have a nozzle surface provided with an anti-wetting coating on an exterior surface of the nozzle surface, but not in the inside of the nozzle, preferably no anti-wetting coating is applied in the inside of the nozzle when manufacturing a nozzle surface of a print head. However, this is difficult to achieve when using known coatings and production procedures. Known manufacturing procedures for preparing a nozzle surface comprise applying a resist layer to one surface of the substrate forming the nozzle surface. However, if such substrate is already provided with an anti-wetting coating, the etch resist may not adhere to the coated substrate and consequently, etching may take place at unwanted positions. When applying an anti-wetting coating after the etching has taken place, it is difficult to selectively apply the coating to an exterior surface of the nozzle surface without coating the inside of the nozzle.

It is therefore an object of the invention to provide a coating and a production method for applying the coating that mitigate the above problems.

SUMMARY OF THE INVENTION

One object of the invention relates to a method for preparing a coated nozzle surface is provided, the method comprising the steps of:

a. Providing a substrate comprising silicon;
b. Applying a coating on the substrate by reacting the substrate with a compound comprising at least a fluorinated alkyl group;
c. Modifying the coated substrate to increase the wetting property of the coated substrate;
d. Applying an etch resist on the coated substrate;
e. Etching the coated substrate, thereby forming through holes in the substrate;
f. Removing the etch resist; and
g. Modifying the coated substrate to decrease the wetting property of the coated substrate.

In one embodiment of the method, a substrate is provided with a coating in a number of steps. The coated substrate is suitable to be used as a nozzle surface, for example.

In step a, a substrate comprising silicon may be provided. Preferably, the substrate may comprise a layer consisting essentially of silicon.

In step b, a coating may be applied on the substrate by reacting the substrate with a compound comprising at least a fluorinated alkyl group. If a compound comprising at least a fluorinated alkyl group is used, the coating may show good anti-wetting property. Optionally, the coating may also show good anti-fouling property. The coating may be formed by reacting the coating and the substrate.

Optionally, the substrate may be pre-treated before it is reacted with the compound comprising at least a fluorinated alkyl group. For example, the substrate may be provided with a monolayer of hydrogen and/or halogen atoms. The hydrogen and/or halogen atoms may provide the substrate with sufficient reactivity to bond a coating to the substrate. The compound comprising a fluorinated alkyl group may further comprise reactive group that allows a chemical reaction between the compound and the substrate, thereby bonding the compound. Examples of such reactive groups are an alkene group, an alkyne group and/or a —$SiX_x$ group, wherein X is a halogen atom, e.g. a trichlorosilane group. For example, the procedure described in "N. S. Bhairamadgi, S. P. Pujari, C. J. M. van Rijn, H. Zuilhof, *Langmuir* 2014, 30, 12532", in particular the procedure regarding "Poly(2-perfluorooctylethyl methacrylate) Brushes (SPF17)" may be applied to provide the substrate with a coating. The substrate is now provided with an anti-wetting coating. This may be useful when the substrate is used as a nozzle surface in a print head, but it may be difficult to apply an additional layer to the coated substrate.

Therefore, the coating is modified in step c. Modification of the coated substrate may be done e.g. by chemical treatment or by applying radiation to the coated substrate. An example of a chemical treatment is e.g. immersion of the coated substrate in a liquid and or spraying of a liquid on the coated substrate. The liquid may be an acidic liquid or an alkali liquid. Alternatively or additionally, a gaseous treatment may be used, for example using an acidic gas. An example of radiation that may be applied to the coated substrate is e.g. ultraviolet radiation. The modification may increase the wetting property of the coated substrate.

In step d, etch resist is applied on the coating. The increased wettability of the coated substrate, due to the modification performed in step c, allows a layer of etch resist to properly adhere to the coated substrate to protect the coated substrate during a later etching step. The etch resist may be applied e.g. by spin coating. The etch resist may be applied in a pre-determined pattern, leaving parts of the coated substrate not covered with the etch resist. The skilled person will be able to select a suitable etch resist material. Non-limiting examples of etch resist are resins and waxes.

In step e, the coated substrate is etched, thereby forming through holes in the coated substrate. The through holes may be formed in parts of the substrate not covered with the etch resist. In parts of the coated substrate that are covered with the etch resist, no material may be etched away and no through holes may be formed.

The through holes may later, for example, when the substrate is used in a print head as a nozzle surface, serve as nozzles.

In step f, the etch resist is removed. This yields a coated substrate, wherein the coating still shows improved wetting property.

In step g, the coated substrate is modified to decrease the wetting property of the coated substrate. This may be done e.g. by heating the coated substrate.

In an embodiment, in step c, the coated substrate is exposed to plasma. Applying plasma may be an effective way to damage the coating. Part of the coating, for example a perfluoroalkyl part of the coating may be oxidized under influence of the plasma. The oxidized part of the coating may show increased wetting property, which may allow a layer of etch resist to adhere to the coating.

In a further embodiment, the plasma is an $O_2$ plasma. Applying oxygen plasma is suitable for (partially) oxidizing the coating, for example a perfluoroalkyl part of the coating.

In an embodiment, in step g, the coated substrate is heated. The coating may comprise a number of polymer chains that may rearrange under influence of heating. Upon heating the coating, the damaged parts may move away from towards the boundary of the coating and the silicon surface, thereby repairing the anti-wetting property of the outer surface of the coating, i.e. the surface of the coating removed from the silicon-coating interface.

The surface may be heated to a temperature of above about 80° C., preferably above 100° C., for example a temperature falling within the range of 120° C.-150° C.

In an embodiment, the coating is applied on the substrate by modifying the surface in a step-wise manner comprising:

i. chemically modifying the substrate;
ii. reacting the modified substrate with a fluoroalkylmethacrylate or a fluoroalkylacrylate.

By chemically modifying the substrate, the reactivity of the substrate towards a reactant may be improved. Chemical surface modification may comprise providing the substrate with a hydrogen monolayer, or a halogen monolayer, e.g. a fluoro monolayer.

In a further process step, the modified substrate may be reacted with a fluoroalkylmethacrylate or a fluoroalkylacrylate, or a mixture of one or more fluoroalkylacrylates and/or one or more fluoroalkylmethacrylates. The fluoroalkyl (meth)acrylate may be bonded directly to the chemically modified surface, or may be bonded to the chemically modified surface via a linking molecule. An example of such method is described in "N. S. Bhairamadgi, S. P. Pujari, C. J. M. van Rijn, H. Zuilhof, *Langmuir* 2014, 30, 12532", in particular in on page 12534, which relates to a silicon substrate provided with a coating of 2-perfluorooctylethyl methacrylate.

In an embodiment, the compound comprising at least a fluorinated alkyl group is selected from at least one of a fluoroalkylmethacrylate and a fluoroalkylacrylate. Such compounds can be bounded to a surface comprising silicon and are suitable to provide the surface with desired properties, such as anti-wetting anti-fouling property.

In a further embodiment, the coating applied in step b. comprises a polymer of a fluoroalkylmethacrylate and/or a fluoroalkylacrylate. A polymer of a fluoroalkylmethacrylate and/or a fluoroalkylacrylate may be suitably used to provide the surface with desired properties, such as anti-fouling property. A polymer of a fluoroalkylmethacrylate and/or a fluoroalkylacrylate may be locally oxidized upon treatment, for example using $O_2$ plasma. The oxidized parts of the polymer may become wetting. As a result, an additional layer, such as an etch resist layer can be applied on top of the (partially) oxidized polymer. Upon treatment of the polymer, e.g. by heating, the oxidized parts may migrate and the polymer may regain its anti-wetting property and anti-fouling property.

The polymer may be applied onto the substrate in one step. Alternatively, the polymer may be applied or built onto the substrate in a plurality of chemical reaction steps.

In an embodiment, a print head is provided, comprising a nozzle surface according to the invention. The print head comprises a nozzle surface provided with a coating having anti-fouling and anti-wetting properties. This may prevent ink to be present on the nozzle surface, which may reduce the risk of nozzle failure. Further, the inside of a nozzle provided in the nozzle surface may not be provided with the anti-wetting coating. As a consequence, the inside of the nozzle may be well wetted, which improves jetting performance of the print head.

In an embodiment, a printer is provided comprising a print head in accordance with the present invention.

BRIEF DESCRIPTION OF THE DRAWINGS

These and further features and advantages of the present invention are explained hereinafter with reference to the accompanying drawings showing non-limiting embodiments and wherein.

In the drawings, the same reference numerals refer to same elements.

DETAILED DESCRIPTION OF THE DRAWINGS

Figure 1A:
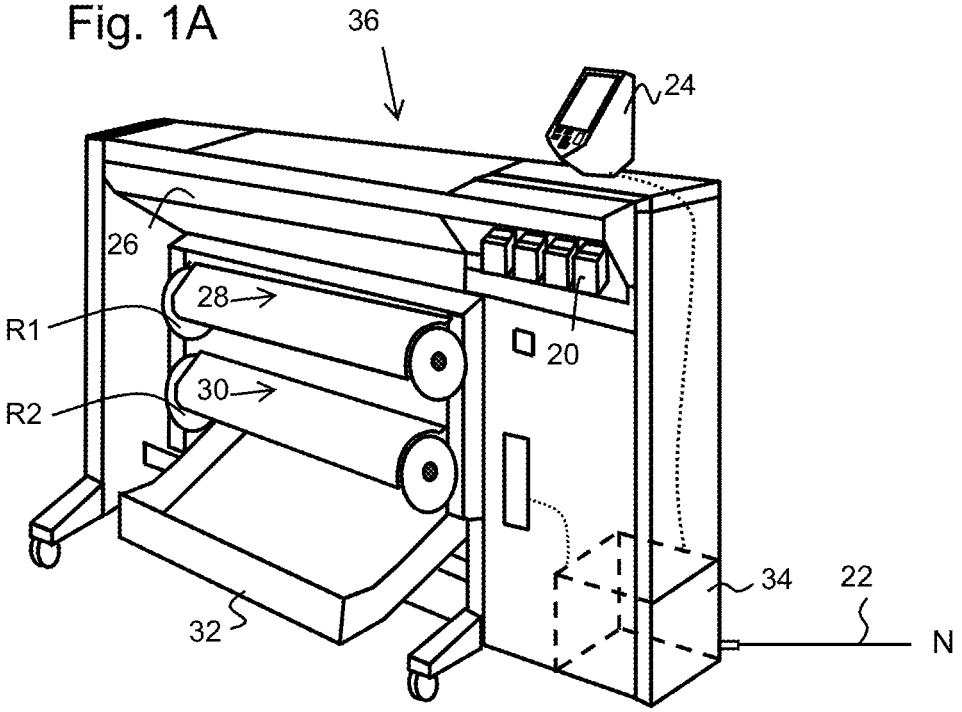
FIG. 1A shows a schematic representation of an image forming apparatus.
Figure 1B:
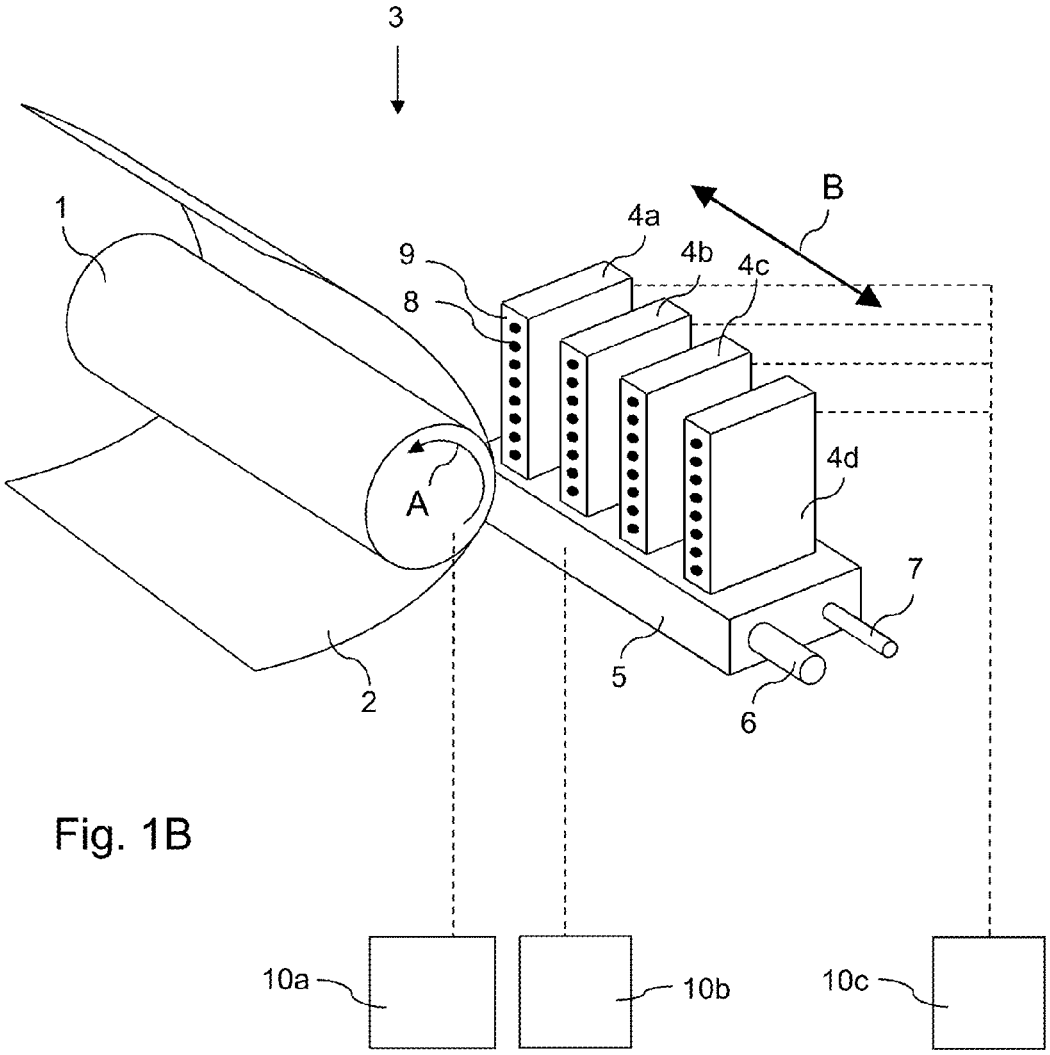
FIG. 1B shows an ink jet printing assembly.

FIG. 1A shows a wide-format image forming apparatus 36, wherein printing is achieved using a wide format inkjet printer. The wide-format image forming apparatus 36 comprises a housing 26, wherein the printing assembly, for example the ink jet printing assembly shown in FIG. 1B, is placed. The image forming apparatus 36 also comprises a storage means for storing image receiving member (for example, roll 28, 30), a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, which comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

The scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 are arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2:
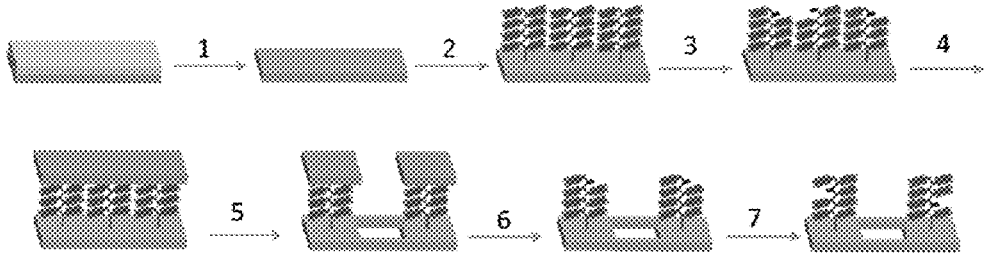
FIG. 2 schematically shows a first embodiment of the method according to the present invention.

FIG. 2 schematically shows a first embodiment of the method according to the present invention. In the first step, the silicon substrate is cleaned by etching. Etching of the substrate removes contaminants and may improve the efficiency of the binding of the coating to the substrate. In the second step, the coating is applied to the substrate. The coating can be applied e.g. by a method described in "N. S. Bhairamadgi, S. P. Pujari, C. J. M. van Rijn, H. Zuilhof, *Langmuir* 2014, 30, 12532", in particular the procedure regarding "Poly(2-perfluorooctylethyl methacrylate)

Brushes (SPF17)". In this method, the coating is applied by stepwise building the polymer onto the substrate. However, alternatively, a polymer may be prepared in advance and this may be bonded to the silicon substrate. By bonding the components forming the coating to the silicon substrate, a coated surface is provided. The coating provides the surface with anti-wetting properties. In step 3, the coated surface is briefly exposed to a plasma, such as an oxygen plasma. Under influence of the plasma, partial oxidation of the coating at the surface of the coating takes place. Because of this oxidation, the coating becomes more wetting at the surface, which allows adhesion of a further layer on top of the coated substrate. In step 4, an etch resist layer is applied on the coated surface. The etch resist layer may protect the coating during further process steps. In step 5, a through hole is etched in the silicon substrate. A predetermined number of through holes may be etched in the silicon substrate in this step. These through holes may form nozzles for ejecting droplets of fluids, when the silicon substrate is incorporated in a print head. The coating and etch resist adhered to the coating is also locally removed at positions of the substrate that are etched away. In step 6, the etch resist layer is removed. This results in a silicon substrate provided with the damaged coating. The damaged coating has reduced anti-wetting properties compared to non-damaged coating (i.e. the coating that is provided in step 2). To regenerate the anti-wetting property of the coated substrate, the coated substrate is treated in step 7. The treatment may comprise heating the coated substrate to rearrange the molecules of the coating, thereby providing the coated substrate with an anti-wetting surface.

Figure 3:
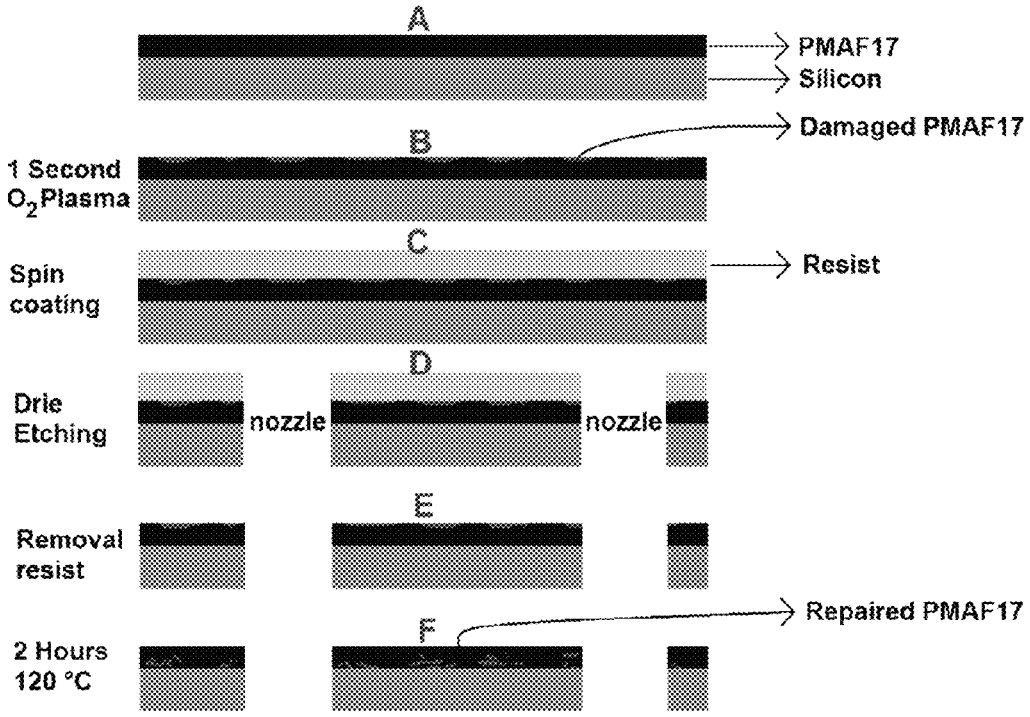
FIG. 3 schematically shows an embodiment of the method according to the present invention.

FIG. 3 schematically shows an embodiment of the method according to the present invention.

In FIG. 3, step A, a silicon substrate provided with a coating is shown. The coating is formed by a PMAF17 (poly(2-perfluorooctyl)ethyl methacrylate)-layer. By exposing the coated silicon substrate to an oxygen plasma, the coating is damaged (FIG. 3, step B). On top of the damaged coating, a layer of etch resist is applied, resulting in a substrate comprising a coating and an etch resist layer on top of the coating (FIG. 3, step C). The etch resist layer protects the coating during etching. In a further step, the coated silicon substrate is locally etched by Deep Reactive Ion Etching (DRIE). As a result, locally the silicon substrate and coating attached to that part of the silicon substrate is etched away, resulting in a silicon surface having through holes (FIG. 3, step D). The through holes may function as nozzles when the silicon substrate is incorporated into a print head. The etch resist layer protects the coating during the etching process. Hence, the coating locally applied to non-etched regions of the silicon surface stay intact. After etching has finished, the etch resist is removed (FIG. 3, step E). The coating is damaged, but can be repaired, for instance, by heating the coated silicon substrate. For example, the coated silicon substrate can be heated for 2 hours to 120° C. (FIG. 3, step F), thereby regenerating the anti-wetting property of the coating. Hence, method according to the present invention may provide a nozzle surface that is covered with an anti-wetting and anti-fouling coating, without applying the coating to the inside of a nozzle.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The invention claimed is:

1. A method for preparing a coated nozzle surface, the method comprising the steps of:

a. providing a substrate comprising silicon;

b. applying a coating on the substrate by reacting the substrate with a compound comprising at least a fluorinated alkyl group;

c. modifying the coated substrate to increase the wetting property of the coated substrate;

d. applying an etch resist on the coated substrate;

e. etching the coated substrate, thereby forming through holes in the substrate;

f. removing the etch resist; and g. modifying the coated substrate to decrease the wetting property.

2. The method according to claim 1, wherein in step c, the coated substrate is exposed to a plasma.

3. The method according to claim 2, wherein the plasma is an $O_2$ plasma.

4. The method according to claim 1, wherein in step g, the coated substrate is heated.

5. The method according to claim 1, wherein in step b, the coating is applied on the substrate by modifying the surface in a step-wise manner comprising:

i. chemically modifying the substrate;

ii. reacting the modified substrate with a fluoroalkylmethacrylate or a fluoroalkylacrylate.

6. The method according to claim 1, wherein the compound comprising at least a fluorinated alkyl group is selected from at least one of a fluoroalkylmethacrylate and a fluoroalkylacrylate.

7. The method according to claim 6, wherein the coating applied in step b comprises a polymer of a fluoroalkylmethacrylate and/or a fluoroalkylacrylate.

8. A print head comprising a nozzle surface obtained by the method according to claim 1.

9. A printer comprising a print head according to claim 8.

* * * * *